US007419335B1

(12) United States Patent
Cohen

(10) Patent No.: US 7,419,335 B1
(45) Date of Patent: Sep. 2, 2008

(54) WALL SUPPORT SYSTEM

(76) Inventor: Steven B. Cohen, 1020 Marcie La., Milford, OH (US) 45150

( * ) Notice: Subject to any disclaimer, the term of this patent is extended or adjusted under 35 U.S.C. 154(b) by 183 days.

(21) Appl. No.: 11/350,323

(22) Filed: Feb. 9, 2006

(51) Int. Cl.
*E02D 5/74* (2006.01)
*E02D 27/50* (2006.01)
*E04G 25/00* (2006.01)

(52) U.S. Cl. ..... 405/244; 405/231; 248/351; 52/293.3; 52/698; 52/223.13

(58) Field of Classification Search ..... 248/351, 248/354.3, 357; 52/293.2, 514, 167.1, 698, 52/223.5; 405/229–231, 244
See application file for complete search history.

(56) References Cited

U.S. PATENT DOCUMENTS

| | | | | |
|---|---|---|---|---|
| 3,537,220 | A | 11/1970 | Ellis | 53/223.5 |
| 4,189,891 | A | 2/1980 | Johnson et al. | 52/741.13 |
| 4,353,194 | A * | 10/1982 | Norton | 52/514 |
| 4,452,028 | A | 6/1984 | Norton et al. | 52/742.14 |
| 4,893,784 | A * | 1/1990 | Abraham et al. | 254/100 |
| 5,154,539 | A | 10/1992 | McCown, Sr. et al. | 405/230 |
| 5,234,287 | A | 8/1993 | Rippe, Jr. | 405/230 |
| 5,246,311 | A | 9/1993 | West et al. | 405/230 |
| 5,399,055 | A | 3/1995 | Dutton, Jr. | 405/230 |
| 5,433,556 | A | 7/1995 | Freeman, III | 405/229 |
| 5,575,591 | A | 11/1996 | Vanderklaauw | 405/230 |
| 5,653,077 | A | 8/1997 | Carnicello et al. | 52/646 |
| 5,794,393 | A | 8/1998 | Fearn | 52/294 |
| 5,797,227 | A | 8/1998 | Garza-Tamez | 52/167.1 |
| 5,845,450 | A | 12/1998 | Larsen | 52/574 |
| 6,079,905 | A | 6/2000 | Ruiz et al. | 405/230 |
| 6,142,710 | A | 11/2000 | Holland, Jr. et al. | 405/230 |
| 6,145,260 | A * | 11/2000 | Morton | 52/293.2 |
| 6,193,442 | B1 | 2/2001 | May | 405/232 |
| 6,357,190 | B1 | 3/2002 | Florentine | 52/293.2 |
| 6,676,335 | B1 | 1/2004 | Hickman | 405/230 |
| 6,763,636 | B2 | 7/2004 | Dimitrijevic | 52/126.1 |
| 6,767,167 | B1 | 7/2004 | Rials | 405/244 |
| 2003/0131543 | A1 | 7/2003 | Hansort | 52/127.2 |
| 2003/0131555 | A1 | 7/2003 | Heady et al. | 52/741.15 |
| 2004/0105727 | A1 | 6/2004 | Jones | 405/231 |

FOREIGN PATENT DOCUMENTS

EP 0 036 795 A1 9/1981

OTHER PUBLICATIONS

"Grip-Tite Wall Anchor System," Internet Site http://www.griptite.com, 2 pages, printed on Oct. 11, 2004.

* cited by examiner

*Primary Examiner*—Tara L. Mayo
(74) *Attorney, Agent, or Firm*—Alfred J. Mangels

(57) ABSTRACT

An arrangement for supporting a building wall, such as a foundation wall, against inward movement caused by shifting of adjacent soil or by hydrostatic forces or other forces acting on the exterior surface of the wall to push it inwardly. The support arrangement includes upper and lower jacking members that each engage respective upper and lower sections of a support beam that is placed vertically against the surface of the wall to be supported. Each jacking member includes a respective jackscrew that is rotatable for applying a wall holding or a wall restoring force to either or both of the upper and lower sections of the wall.

18 Claims, 12 Drawing Sheets

WALL SUPPORT SYSTEM

BACKGROUND OF THE INVENTION

1. Field of the Invention

The present invention relates to a supporting arrangement for supporting a building wall, such as a foundation wall, against externally-caused forces tending to move the wall, or a part of the wall, inwardly toward the interior of the structure of which the wall is a part. More particularly, the present invention relates to a wall support that includes upper and lower jacking members for acting against upper and lower portions of a beam that is positioned against the interior surface of the wall to be supported, for transferring supporting forces from the jacking members to the interior surface of the wall, either to support the wall or to push the wall outwardly from an inwardly-deflected position.

2. Description of the Related Art

Building walls, such as foundation walls that are below ground level, are subjected to external forces that act against the wall outer surface. For foundation walls, such forces result from the pressure of the surrounding earth that abuts the outer surface of the wall. Additionally, hydrostatic forces caused by water in the ground adjacent to the wall, either from rainfall or other sources, can add significantly to the inwardly-directed forces that act on the outer surfaces of foundation walls. Further, the roots of foundation plants and trees, that enlarge and spread over time, can also exert pressures against foundation walls by slowly expanding toward the wall outer surface, acting against the wall outer surface by direct contact, or indirectly by expanding and pushing the earth surrounding the roots against the wall surface.

As a result of forces applied to their exterior surfaces, foundation walls can bow, deflect, or shift inwardly, or they can crack or progressively fracture over time, causing water leaks and adversely affecting the structural integrity of the building or structure of which the wall is a part. Accordingly, some means of interiorly-positioned support is desirable to control or limit inward wall deflection to avoid collapse of the wall.

A number of different wall supporting arrangements have been devised to overcome inward movement or inward deflection of foundation walls. Some of the previously-devised support arrangements involve externally-positioned, in-ground anchors placed in the ground adjacent to the outer surface of the wall. Those arrangements generally include a rod that is suitably anchored in the earth at an outer end and is connected to or extends through the wall to serve as a stop to limit inward movement of the wall. Other support arrangements that are intended to be positioned adjacent the interior surface of the wall are of a large and complex nature and protrude into the interior space to such an extent as to significantly limit the useable area of that interior space. It is therefore desirable to provide a wall support arrangement that is effective to limit inward movement of a building wall, that is readily adjustable to respond to changed wall loading conditions and deflection, and that does not excessively intrude into the adjoining interior space.

SUMMARY OF THE INVENTION

Briefly stated, in accordance with one aspect of the present invention, a support arrangement is provided for supporting a foundation wall. The support includes an upper jacking member that is rigidly connected with at least one ceiling joist and that is positioned adjacent the wall to be supported. A lower jacking member is positioned below and spaced from the upper jacking member, wherein the lower jacking member is rigidly connected with a flow at a position adjacent the wall. A support beam extends between and is in contact with the upper and lower jacking members and with a surface of the wall. An adjustment system is provided at each of the upper and lower jacking members for applying a supporting force against the beam, for pressing the beam against the wall surface and for supporting the wall against external forces acting to move the wall in a direction opposite to the supporting force.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE PREFERRED EMBODIMENTS

Figure 1:
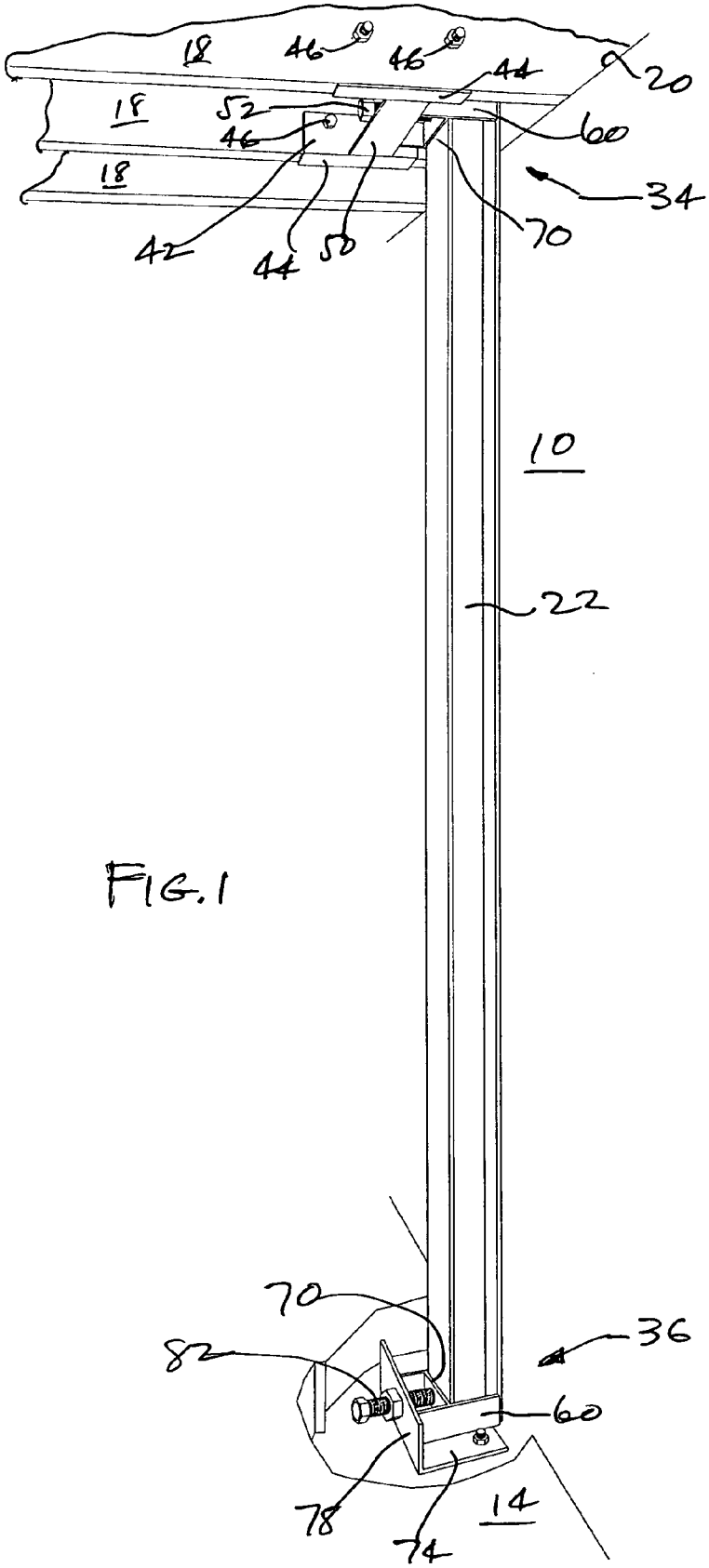
FIG. 1 is a perspective elevational view of a portion of a building foundation showing an embodiment of a wall support arrangement for supporting a wall that is perpendicular to a ceiling joist direction.
Figure 2:
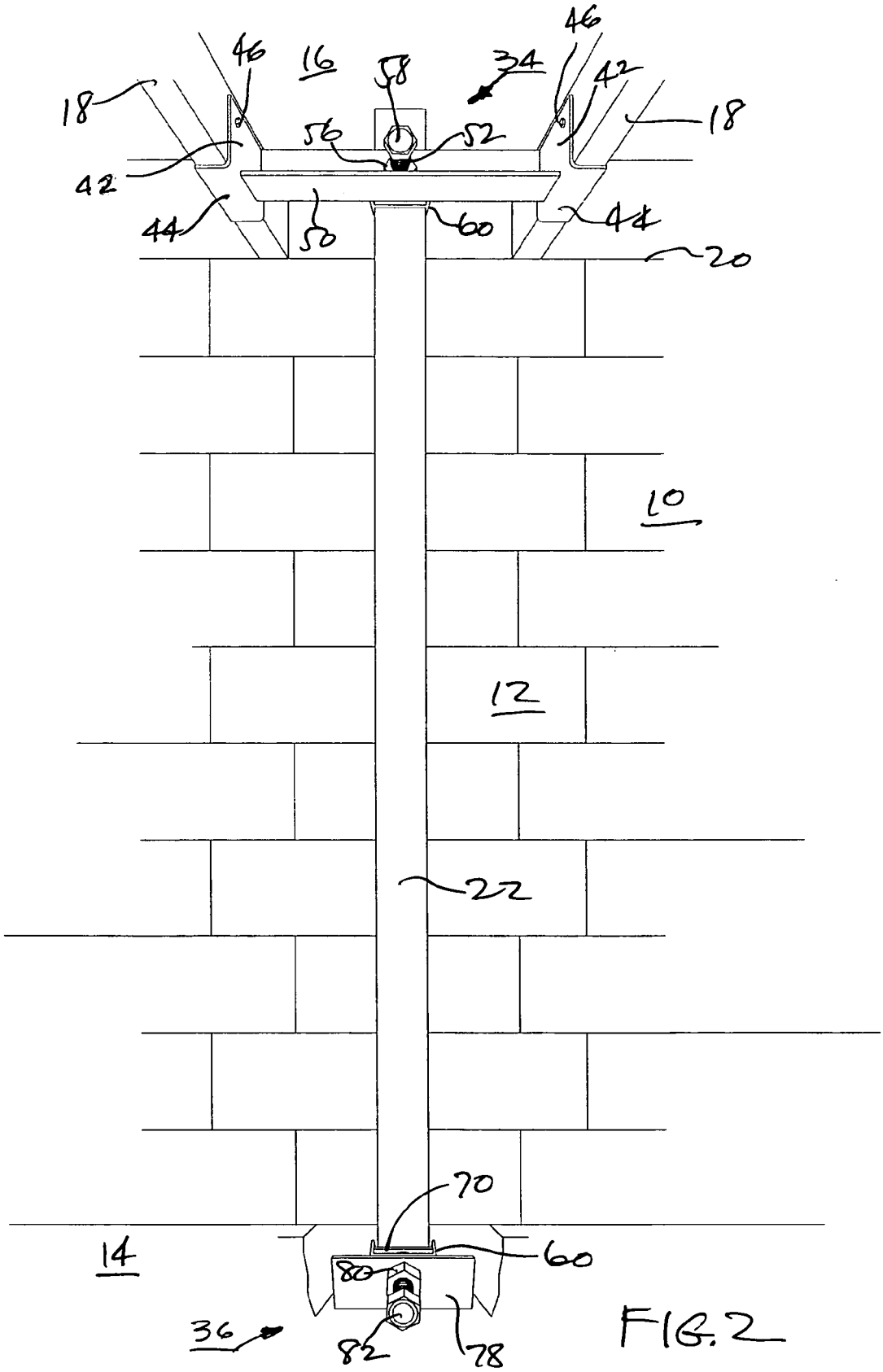
FIG. 2 is a front elevational view of the wall support arrangement shown in FIG. 1.
Figure 5:
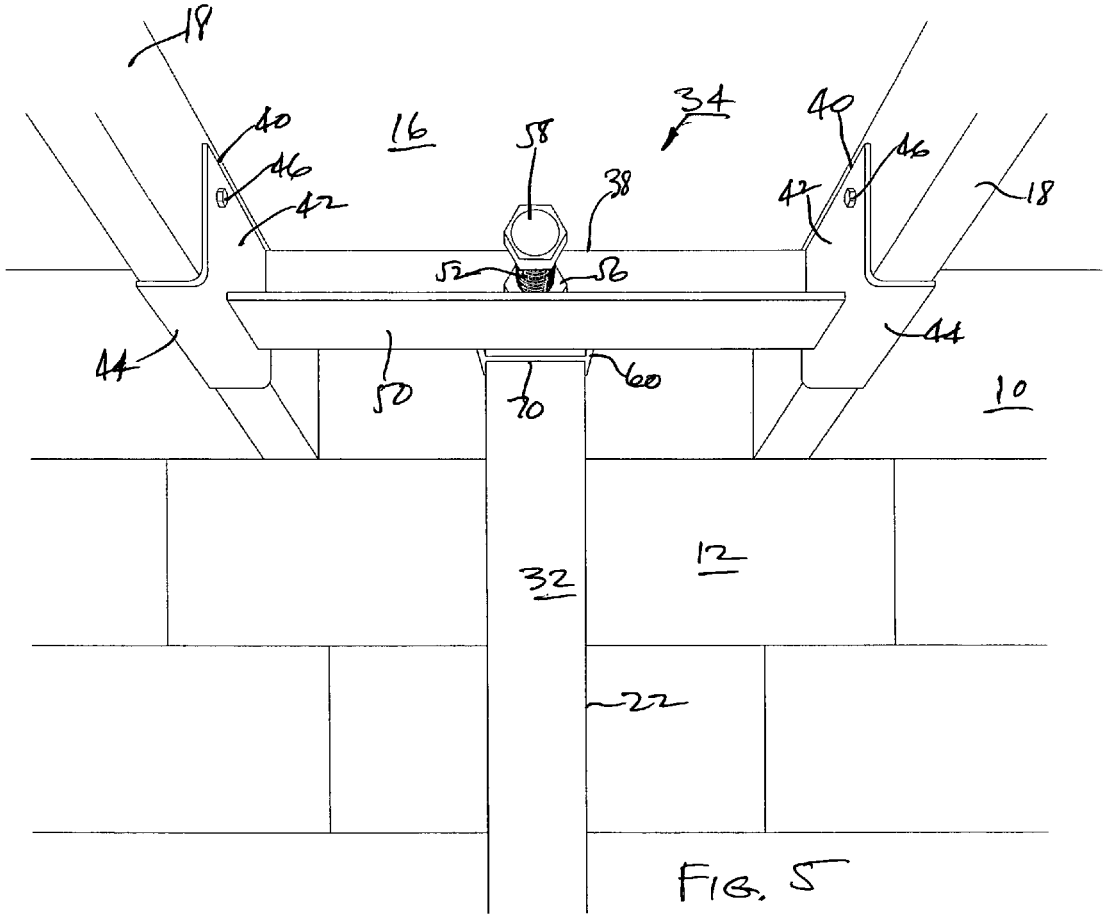
FIG. 5 is a front view of an upper support beam jacking member.

Referring to the drawings, and particularly to FIGS. 1 and 2 thereof, there is shown a portion of a foundation wall 10 that encloses a below-ground basement area of a building. Wall 10 as shown is a block wall that is formed from a plurality of rows of horizontally-aligned, vertically staggered or offset blocks 12 that can be produced from concrete, cinders, or the like, and that are interconnected by mortar-filled joints. Alternatively, wall 10 can be a poured concrete wall, or a modular concrete wall formed from connected precast concrete modules.

The basement area includes a concrete floor 14 that is substantially perpendicular to wall 10. A ceiling 16 is provided by a subfloor of an upper floor or an upper living level.

Ceiling 16 is supported by a plurality of spaced, parallel ceiling joists 18 that are generally wood beams of rectangular cross section. The spacing between adjacent ceiling joists is generally 16 inches center-to-center. As shown, ceiling joists 18 have one longitudinal end that is positioned above the upper surface 20 of wall 10 and that generally rests on a wood sill plate (not shown) that lies on wall upper surface 20. The opposite ends of ceiling joists 18 either rest on a cross beam (not shown) that is spaced from and parallel to wall 10, or they are rigidly connected with respective ends of other, similarly-sized, parallel ceiling joists (not shown) that have their ends supported by an opposite wall (not shown).

Figure 3:
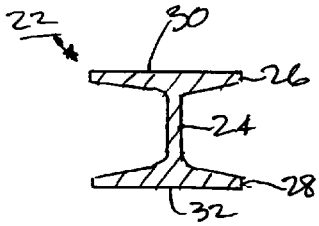
FIG. 3 is a cross-sectional view of a support beam in the form of an I-beam.
Figure 4:
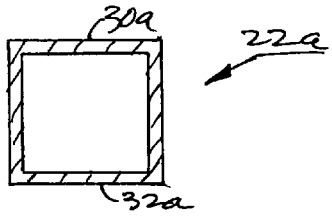
FIG. 4 is a cross-sectional view of a support beam in the form of a box beam.
Figure 6:
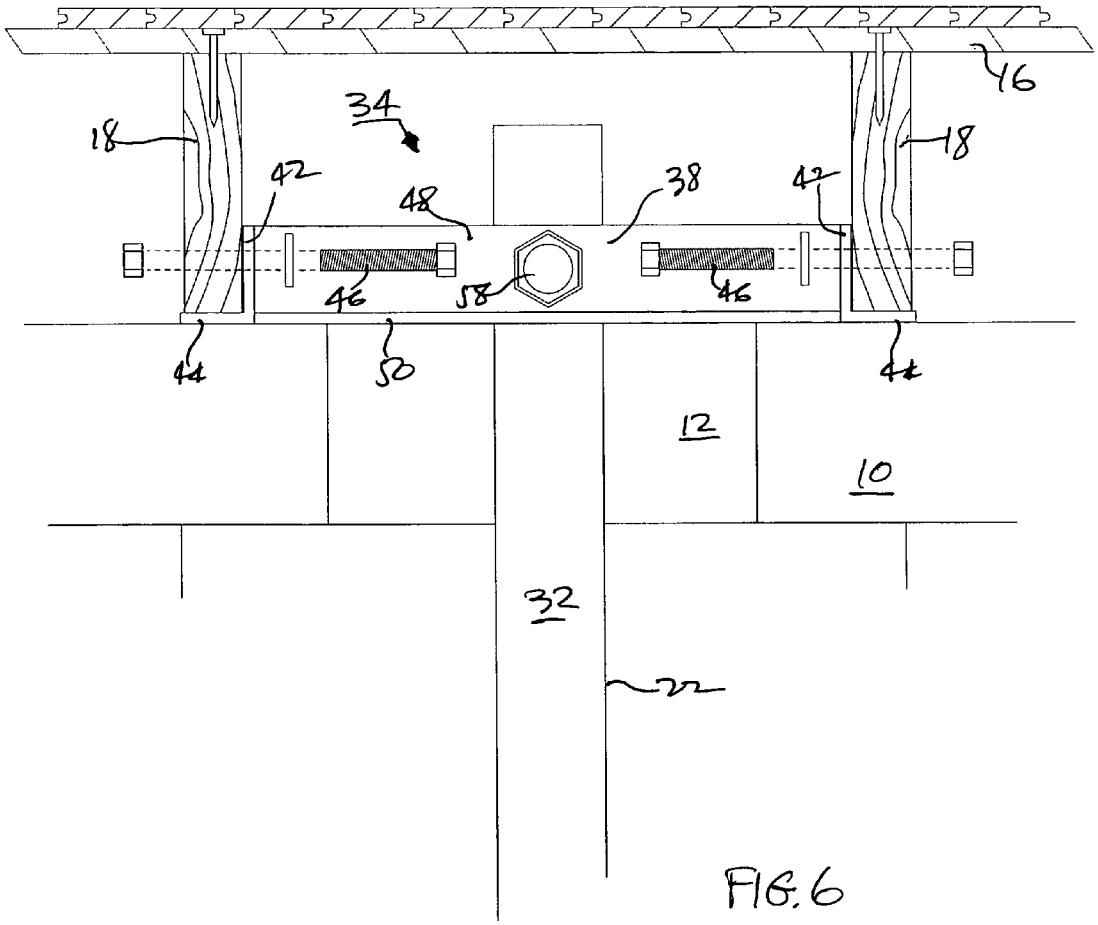
FIG. 6 is a front exploded view of the upper support beam jacking member of FIG. 5.

Positioned vertically between floor 14 and ceiling 16 and in surface-to-surface contact with wall 10 is a wall support beam 22 that serves as the wall support or wall bracing for wall 10. Wall support beam 22 as shown in FIGS. 1 and 2 is an I-beam, having the cross section illustrated in FIG. 3 and including a central web 24 and end flanges 26, 28 that each include respective parallel, flat outer surfaces 30, 32, one of which outer surfaces is positioned against the inner surface of wall 10. Although shown and described as an I-beam, wall support beam 22 can be of another form, such as the box beam 22*a* illustrated in cross section in FIG. 4, having a pair of opposite, parallel side surfaces 30*a*, 32*a*, or it can have a different cross-sectional form that includes at least one flat surface that is adapted to face and to contact the inner surface of wall 10.

Wall support beam 22 is held against the surface of wall 10 by a pair of vertically spaced, adjustable jacking members. An upper jacking member 34 is connected to and is supported by a pair of adjacent ceiling joists 18, and it engages the surface of support beam 22 at an upper section of the beam adjacent to ceiling 16. A lower jacking member 36 is connected to and is supported on or below the surface of floor 14 and engages the same surface of support beam 22 at a lower section of the beam at a point adjacent to floor 14. By suitably adjusting upper and lower jacking members 34, 36, outwardly-directed pressure can be applied to the inner surface of wall 10 through wall support beam 22 to maintain wall 10 in a particular position, or to press against wall 10 to return it from an inwardly-bowed or deflected position to or near an original upright and substantially flat position. If either of support beam surfaces 30 or 30*a*, depending upon which form of support beam is utilized, faces wall 10, then the corresponding opposite support beam surface 32 or 32*a* is contacted by respective upper and lower jacking members 34, 36, as will be further described.

FIGS. 5 through 8 show several view of one embodiment of upper jacking member 34. A cross member 38 extends substantially perpendicularly to the opposed sides of each of a pair of adjacent, spaced ceiling joists 18. Cross member 38 has an L-shaped cross section and can be a single-piece angle or two plates that are welded together to form an L in cross section. The longitudinal ends of cross member 38 are rigidly attached to respective side members 40, such as by welding, to provide a rigid support structure. Side members 40 can also have an L-shaped cross section, including a flat side panel 42 and a flat bottom panel 44 that are perpendicular to each other. As was the case with cross member 38, side members 40 can be a single piece angle or two plates welded together to form an L-shape in cross section. Side members 40 are each secured to respective adjacent ceiling joists 18, such as by a pair of connecting bolts 46, or the like, to attach the side panels to respective opposed sides of adjacent joists 18. Bottom panels 44 lie against the bottom edges of the respective joists. Cross member 38 includes a back panel 48 that is substantially parallel to the inner surface of wall 10, and a bottom panel 50 that is substantially perpendicular to back panel 48.

Figure 7:
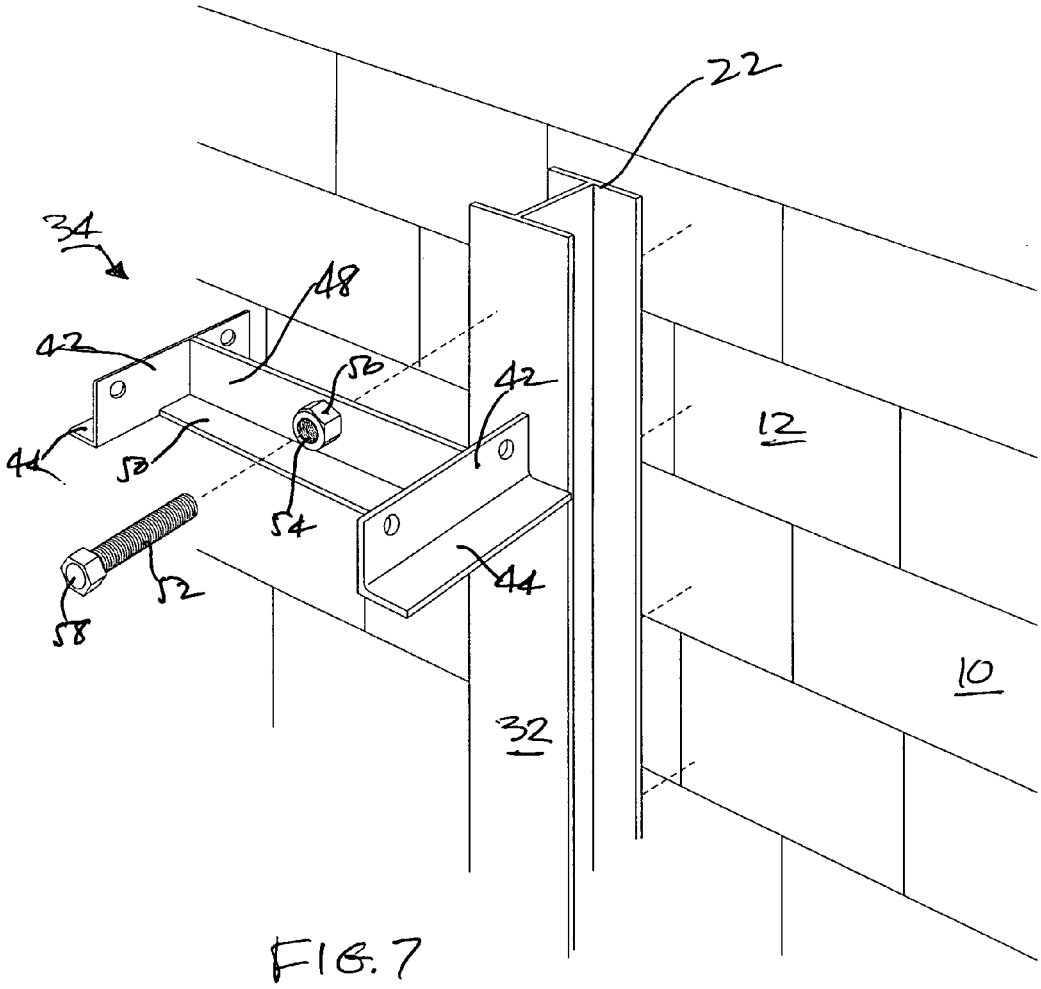
FIG. 7 is a fragmentary exploded perspective view of the upper support beam jacking member of FIG. 5.
Figure 8:
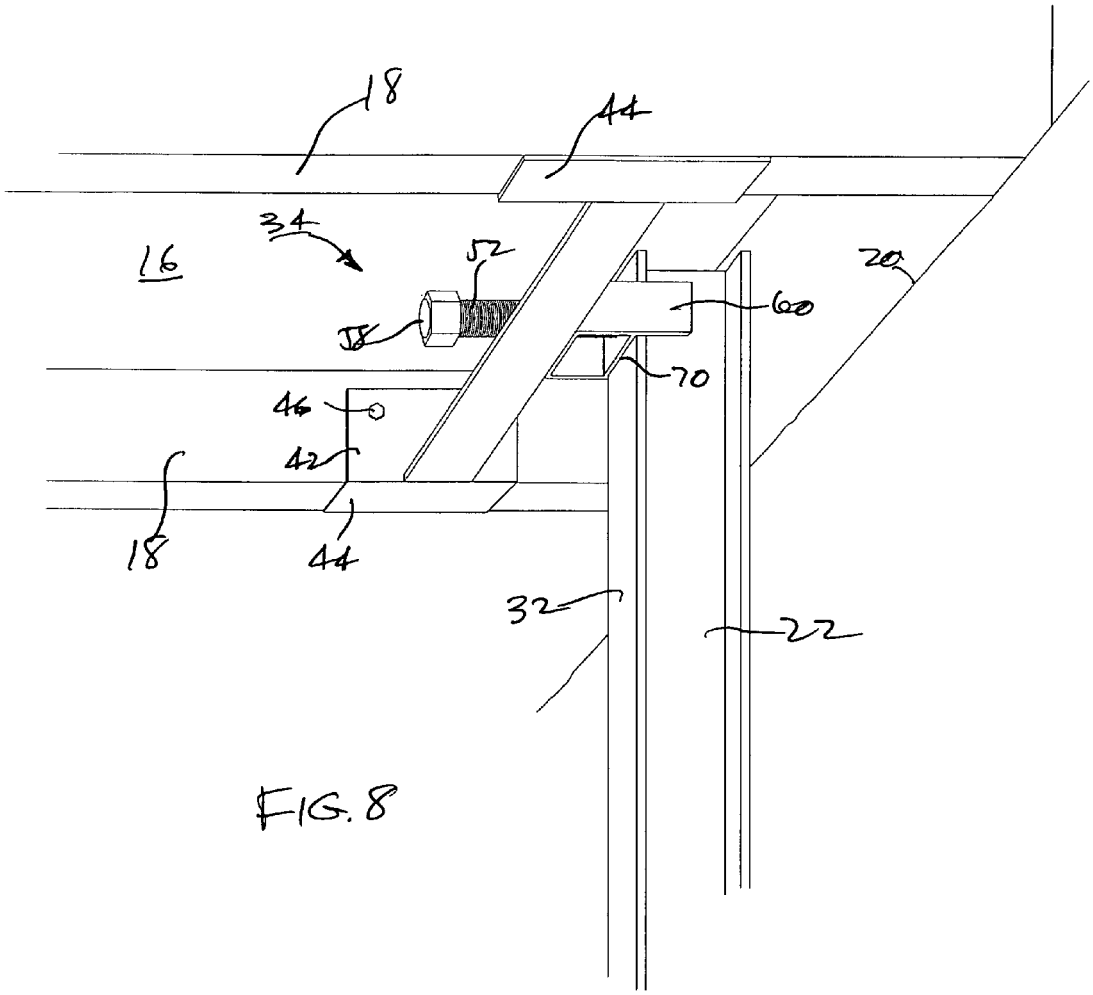
FIG. 8 is a bottom perspective view of the upper support beam jacking member of FIG. 5.

Upper jacking member 34 includes an upper jackscrew 52 that is threadedly received in a correspondingly threaded aperture 54 positioned at substantially the center of back panel 48 of cross member 38 between adjacent joists 18. Threaded aperture 54 can be provided by cutting a thread in back panel 48, or it can be provided in the form of a threaded nut 56 that is affixed to back panel 48, such as by welding as shown in FIG. 7, so that it is coaxial with a similarly-sized, unthreaded opening in back panel 48 to allow jackscrew 52 to pass therethrough.

A drive head 58, such as a hex head, or the like, is fixedly secured to the outermost end of jackscrew 52. Drive head 58 enables the jackscrew to be rotated by a suitable tool so that the innermost end of jackscrew 52 can be moved toward and away from support beam 22. Drive head 58 can be in the form of a hexagon, a square, or the like, having a pair of opposed flat surfaces for engagement by a suitable turning tool, such as an open end wrench. Drive head 58 can also be in the form of a disk or a plate (not shown) that has a drive opening that extends substantially radially relative the longitudinal axis of jackscrew 52. The drive opening is adapted to receive the end of a suitable turning tool, such as a lever or a bar having a cross section that corresponds with the shape of the drive opening.

The innermost end of upper jackscrew 52 adjacent to support beam 22 is adapted to transmit an axial restoring force against a bearing member 60 that bears against the surface of the support beam. Bearing member 60 is positioned between jackscrew 52 and face 32 of support beam 22.

Figure 9:
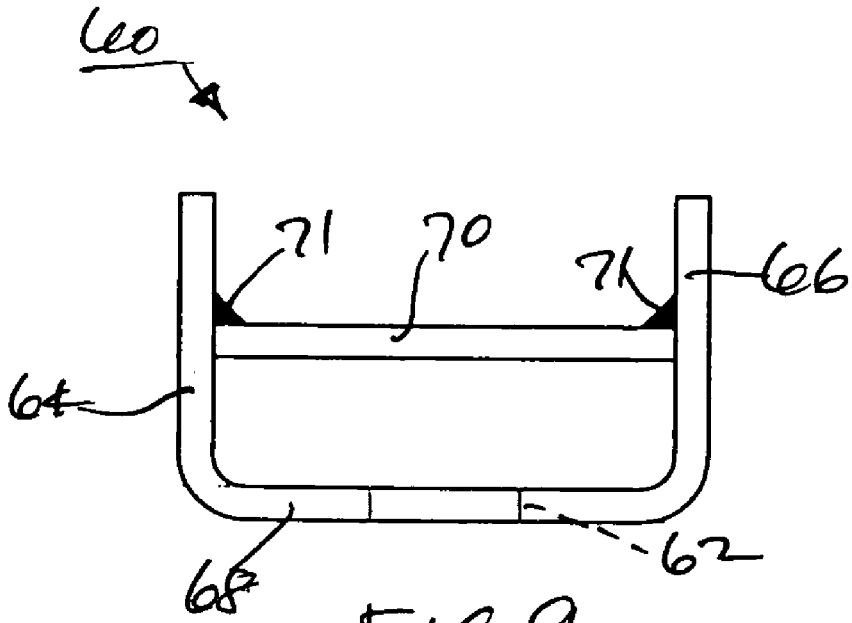
FIG. 9 is a top view of a support beam bearing member.

Bearing member 60 can be merely a flat plate that serves to distribute the axial force of jackscrew 52 over a larger area of face 32 of support beam 22 than the end area of the jackscrew. Alternatively, bearing member 60 can have the configuration shown in FIGS. 9 and 10. As shown in those figures, bearing member 60 includes a U-shaped channel section that has a height sufficient to accommodate an opening 62 to allow passage therethrough of jackscrew 52. Bearing member 60 also includes spaced, parallel sidewalls 64, 66 that are interconnected by front wall 68. An intermediate, generally rectangular, bearing wall 70 extends between and interconnects sidewalls 64, 66, and is spaced from and is parallel to front wall 68. The spacing between the inner surfaces of sidewalls 64,66 is sufficient to allow the sidewalls to lie adjacent to the longitudinal edges of face 32 of support beam 22, so that the outwardly-facing face of bearing wall 70 is in substantial surface-to-surface contact across substantially the entire width of face 32 of support beam 22. As can be seen in FIG. 9, bearing wall 70 is welded at its respective outer ends by welds 71 to the opposed inner surfaces of each of sidewalls 64, 66. If desired, a lock nut or jam nut (not shown) can be rotatably carried on jackscrew 52 to enable locking contact with either threaded nut 56 or with the back face of front wall 68 of bearing member 60 for securely locking jackscrew 52 in a predetermined, non-rotatable position relative to wall support beam 22.

Figure 11:
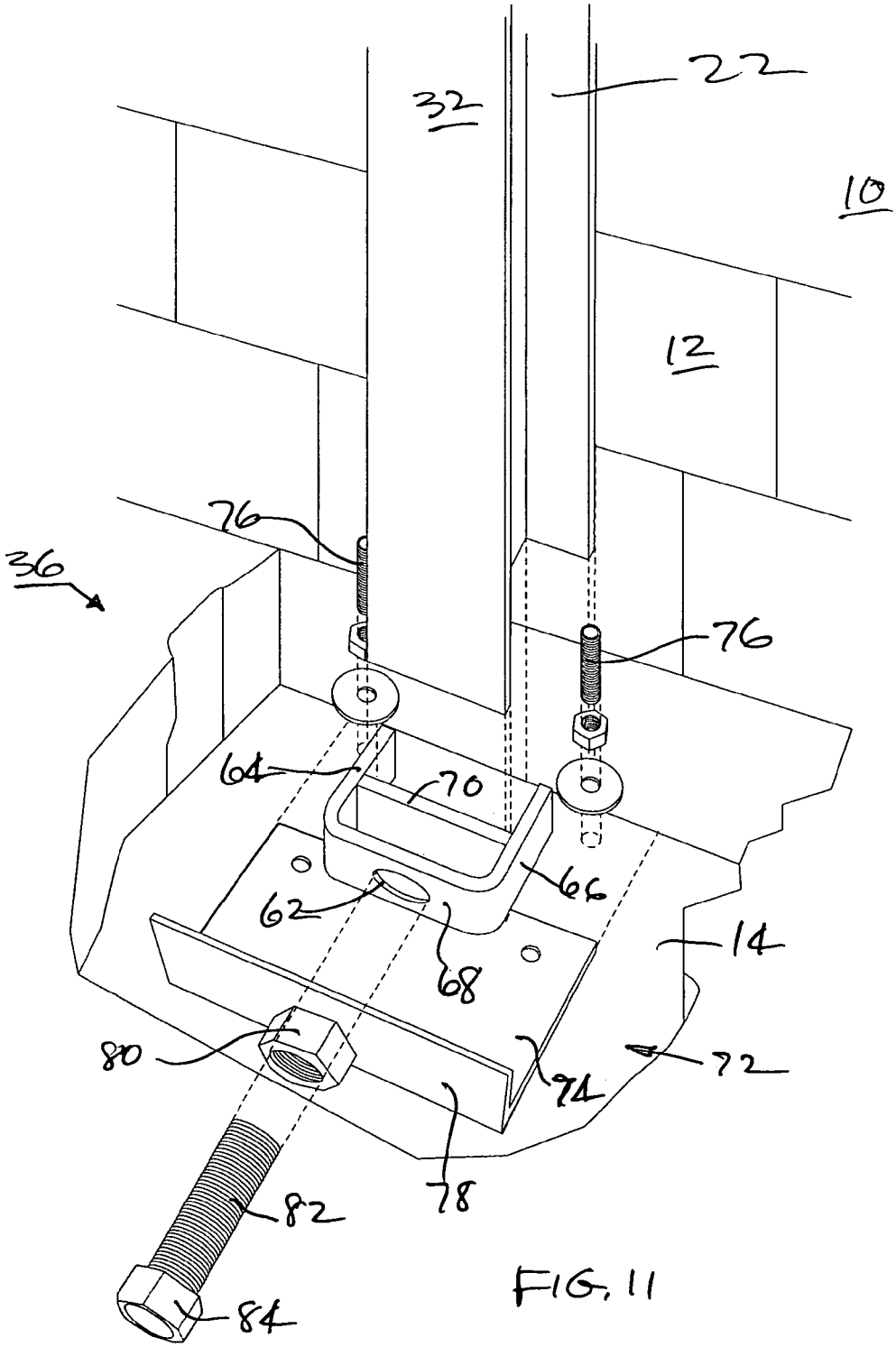
FIG. 11 is an exploded view of a lower support beam jacking member.
Figure 12:
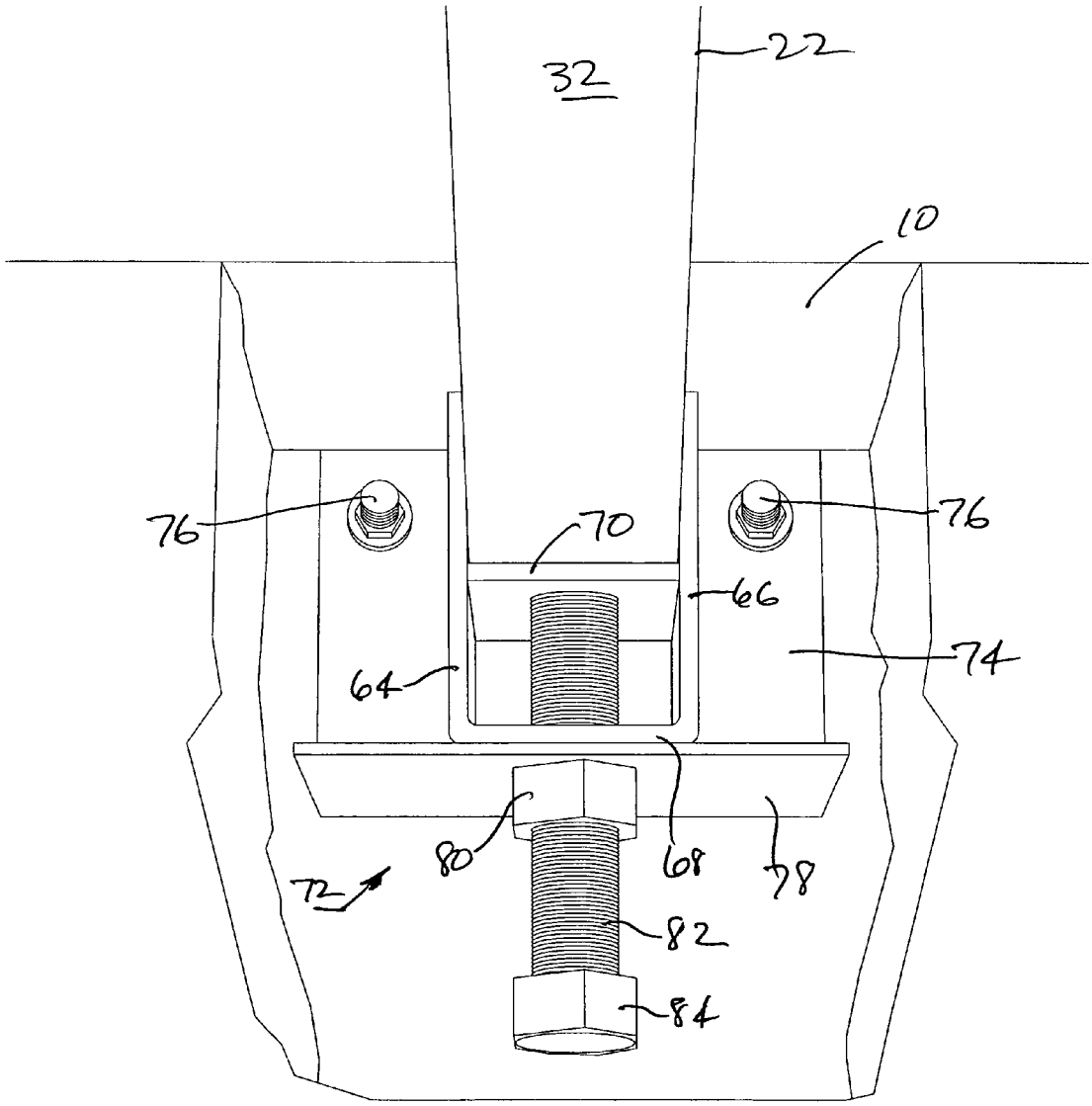
FIG. 12 is a top view of the lower support beam jacking member shown in FIG. 11.
Figure 13:
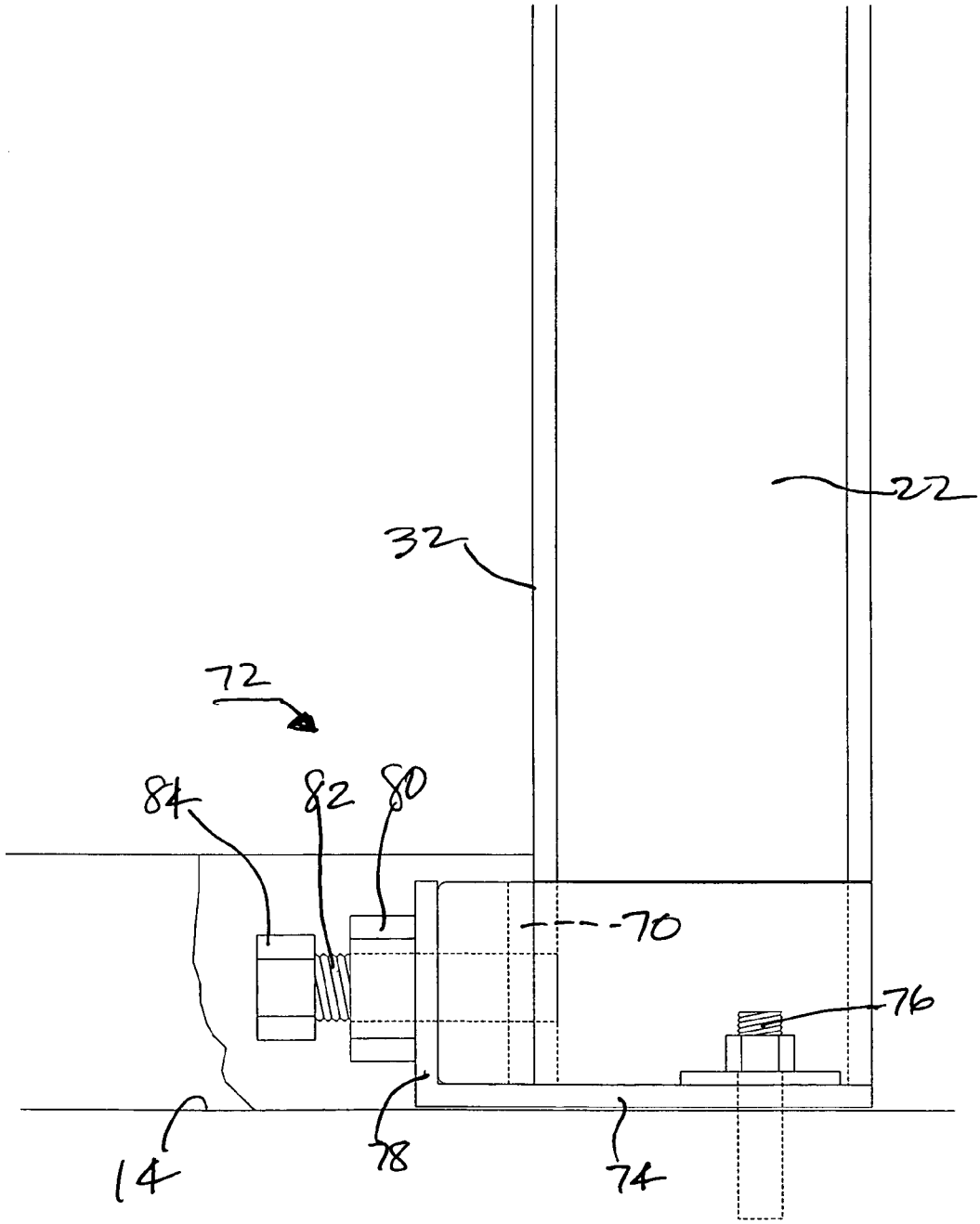
FIG. 13 is a side view of the lower support beam jacking member shown in FIG. 11.

Referring now to FIGS. 11 through 13, there is shown one form of a lower jacking member 36. An angle member 72 includes a first leg 74 that is secured to floor 14 adjacent to wall 10 by a pair of studs 76 that are suitably anchored in floor 14. Angle member 72 is oriented so that second leg 78 extends substantially perpendicular to floor 14 and is substantially parallel to the surface of wall 10. Second leg 78 includes a threaded aperture 80 in the form of a hex nut that is welded to the outer face of second leg 78 and that is substantially centrally positioned between studs 76. Second leg 78 rotatably receives lower jackscrew 82, at the outermost end of which is rigidly secured a drive head 84 to enable lower jackscrew 82 to be rotated so that the innermost end of the jackscrew can be moved toward and away from surface 32 of support beam 22. As was the case with upper drive head 58, lower drive head 84 can be in the form of a hexagon, a square, or the like, having opposed flat surfaces for engagement by a suitable turning tool, such as an open end wrench. Drive head 84 can also be in the form of a disk or a plate (not shown) that has a drive opening that extends substantially radially relative the longitudinal axis of lower jackscrew 82. The drive opening is adapted to receive the end of a suitable turning tool, such as a lever having a cross section that corresponds with the shape of the drive opening.

Figure 10:
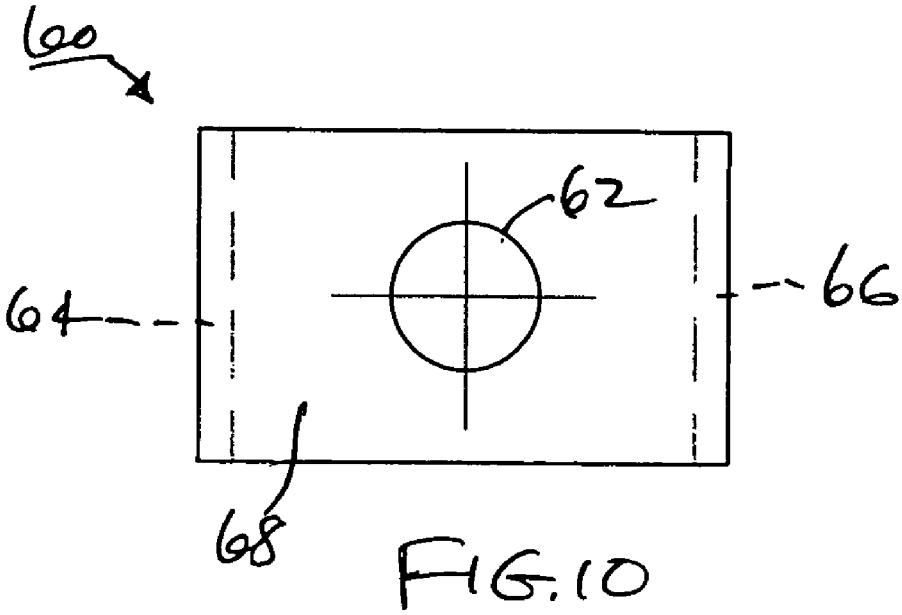
FIG. 10 is a front view of the support beam bearing member of FIG. 9.

Lower jacking member 36 includes a bearing member 60 that can have the structure shown in FIGS. 9 and 10. The innermost end of lower jackscrew 82 adjacent to support beam 22 is adapted to transmit an axial restoring force against bearing member 60 that bears against the surface of the support beam. Bearing member 60 is positioned between jackscrew 82 and face 32 of support beam 22. A face of bearing member 60 is positioned so that it is in face-to-face contact with outer surface 32 of support beam 22, which is the surface that faces away from wall 10. If desired, a lock nut (not shown) can be rotatably carried on jackscrew 82 for engagement with either threaded nut 80 or the back face of second leg 78 for securely locking jackscrew 82 in a predetermined, non-rotatable position relative to wall support beam 22.

Figure 14:
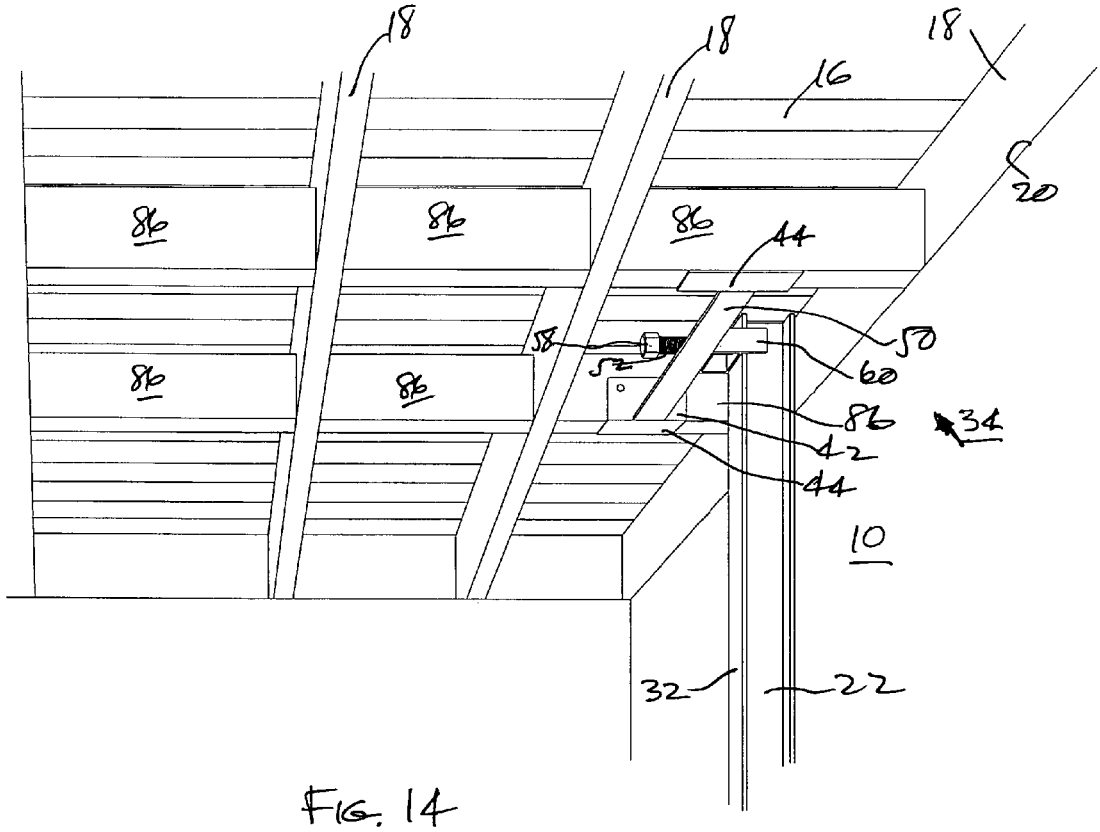
FIG. 14 is a perspective view of the upper support beam jacking member installed to support a wall that is parallel to the ceiling joist direction.

In the embodiment of the invention shown in FIGS. 1 through 6, upper jacking member 34 is shown disposed between a pair of joists 18 that extend perpendicularly to the wall that is to be supported or adjusted. A similar arrangement of upper jacking member 34 can be utilized to support a wall that is parallel to the joist direction. Referring to FIG. 14, joists 18 extend parallel to wall 10. In order to provide structural members to which side plates 40 can be connected, a pair of parallel, intermediate bracing members 86 can be provided to extend perpendicularly to the joists and to extend between and connect with either a pair of adjacent joists 18 or an interior joist 18 and a rim joist 18. If desired, additional bracing members 86 can be attached to and between additional interior joists 18 in order to distribute the wall resistance or the wall inward pressure load over additional joists.

Figure 15:
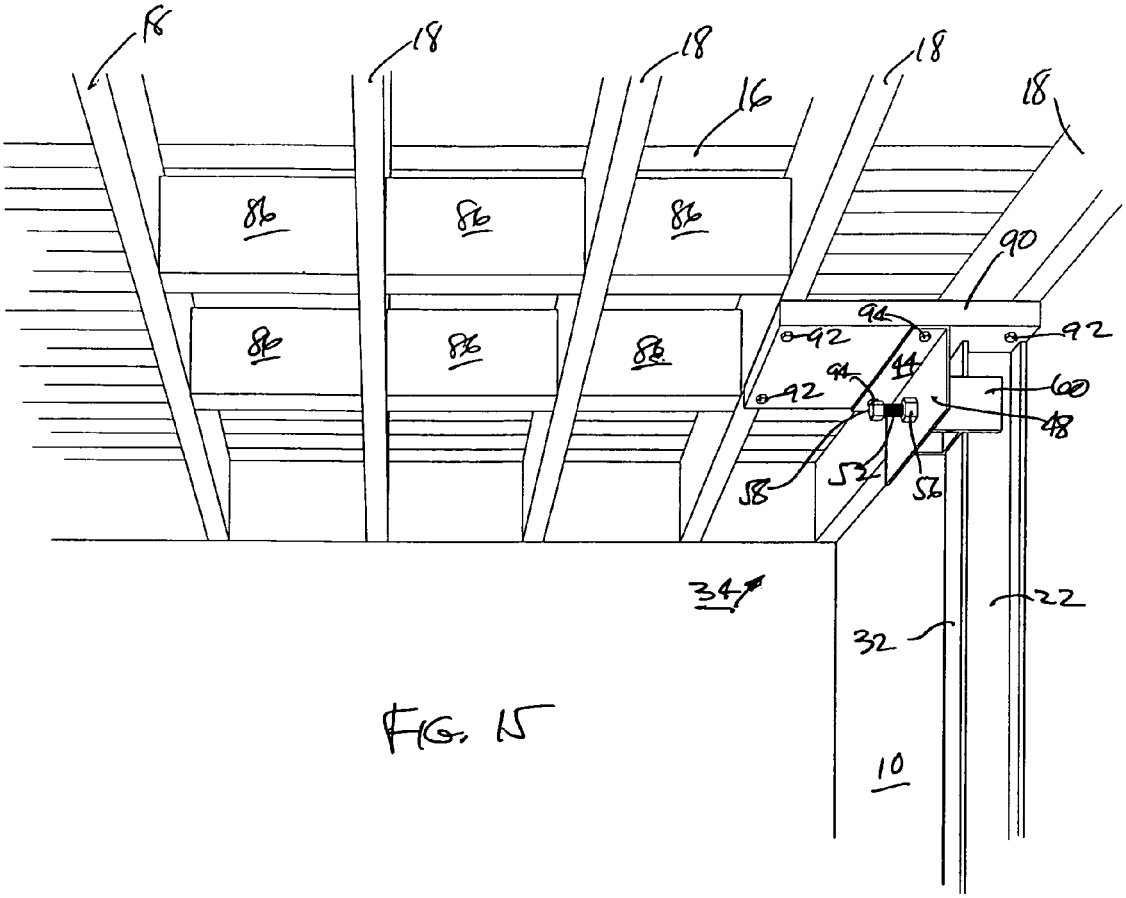
FIG. 15 shows another embodiment of an upper support beam jacking member for supporting a wall that is parallel to the ceiling joist direction.

FIG. 15 shows another embodiment of an upper support beam jacking member for supporting a wall that is parallel to the ceiling joist direction. Instead of the attachment of upper jacking member 34 directly to a pair of parallel internal bracing members 86 as shown in FIG. 14, it is secured to a flat support panel 90 that extends between and is attached to a pair of adjacent joists 18. Support panel 90 can be a section of 2×10 lumber, or it can be a metallic plate, that is bolted to each of successive joists 18 adjacent to wall 10 by at least two bolts 92. The angle member that threadedly receives upper jack screw 52 is inverted relative to its orientation as shown in FIG. 14, with bottom panel 50 uppermost and positioned against support panel 90 and secured thereto by a pair of bolts 94. The positions of back panel 48 and bearing member 60 relative to wall support beam 22 are unchanged from FIG. 14. As was shown in FIG. 14, the FIG. 15 embodiment also includes additional pairs of parallel bracing members 86 attached to and extending between the next succeeding three joists 18 to distribute the wall resistance of the wall inward pressure load over additional joists.

Although not shown in FIGS. 14 and 15, the wall support arrangements there shown also include a lower jacking member having the structure and function of lower jacking member 36 shown in FIGS. 1, 2, and 11 through 13.

As will be apparent, the pressure that is applied to the interiorly-facing surface of wall 10 by wall support beam 22 can be adjusted by turning either or both of upper and lower jackscrews 52, 82 in an appropriate direction. By turning either jackscrew inwardly, beam 22 presses more firmly against the interior surface of wall 10, and by turning either jackscrew outwardly, beam 22 presses less firmly against the interior surface of wall 10. With the support structure in accordance with the present invention, the pressure applied against upper and lower portions of wall 10 can be adjusted as needed to respond to and to counteract as needed the inwardly-directed forces acting on either or both of the upper and lower portions of the surface of wall 10.

Although particular embodiments of the present invention have been illustrated and described, it will be apparent to those skilled in the art that changes and modifications can be made without departing from the spirit of the present invention. Accordingly, it is intended to encompass within the appended claims all such changes and modifications that fall with the scope of the present invention.

What is claimed is:

1. An adjustable wall support for supporting a building wall, said support comprising:

an upper jacking member rigidly supported by each of a pair of spaced ceiling joists and positioned adjacent to and spaced from a substantially vertical building wall to be supported;

a lower jacking member positioned vertically below and spaced from the upper jacking member, the lower jacking member rigidly connected with a floor at a position adjacent to and spaced from the wall;

a wall support beam extending between and in contact with the upper and lower jacking members and with a surface of the wall, wherein the wall support beam is movable by each of the upper and lower jacking members in a direction toward the building wall by at least one of the upper and lower jacking members;

an adjustment system at each of the upper and lower jacking members for applying respective upper and lower support forces toward the building wall to be supported and against a substantially vertically extending surface of the support beam for pressing an opposite substantially vertically extending surface of the support beam against the wall surface to support the wall against external forces acting against the wall in a direction opposite to the support forces.

2. A wall support in accordance with claim 1, wherein the wall support beam is an I-beam having oppositely-facing front and rear surfaces and an intermediate connecting web extending between the front and rear surfaces of the I-beam, wherein the front surface is in contact with the upper and lower jacking members and the rear surface is in contact with the wall surface.

3. A wall support in accordance with claim 1, wherein the wall support beam is a box beam having oppositely-facing front and rear surfaces, wherein the front surface is in contact with the upper and lower jacking members and the rear surface is in contact with the wall surface.

4. A wall support in accordance with claim 1, wherein the upper jacking member includes a cross member extending between and supported between adjacent ceiling joists.

5. A wall support in accordance with claim 4, including a side plate connected at each longitudinal end of the cross member and securely attached to a vertical face of an adjacent ceiling joist.

6. A wall support in accordance with claim 5, wherein each side plate includes a lower lip for engagement with a lower edge surface of an associated ceiling joist.

7. A wall support in accordance with claim 4, including a threaded aperture provided in the cross member and a threaded jackscrew rotatably received in the threaded aperture, wherein the jackscrew is arranged to impart a force against an upper section of the support beam to press the support beam against the wall surface.

8. A wall support in accordance with claim 7, including a drive element rigidly carried by a first, outer end of the jackscrew for receiving a drive member for rotating the jackscrew relative to the cross member.

9. A wall support in accordance with claim 8, wherein the drive element includes a pair of parallel flat surfaces for receiving a tool for turning the jackscrew.

10. A wall support in accordance with claim 8, wherein the drive element includes a substantially radially-extending aperture for receiving a tool for turning the jackscrew.

11. A wall support in accordance with claim 8, including bearing member rotatably received at a second, inner end of the jackscrew, and a bearing plate carried by the bearing member for engagement with a surface of the support beam to transmit support forces to the wall through the support beam.

12. A wall support in accordance with claim 7, wherein the cross member is an angle member that includes a first leg having the threaded aperture and oriented substantially parallel to the wall surface, and a second leg extending substantially perpendicular to the first leg.

13. A wall support in accordance with claim 1, wherein the lower jacking member includes an angle member having a first leg oriented substantially parallel to the wall surface, wherein the first leg includes a threaded aperture and a jackscrew rotatably received in the threaded aperture, and wherein the lower jacking member includes a second leg substantially perpendicular to the first leg for engagement with and attachment to the floor.

14. A wall support in accordance with claim 13, including a drive element rigidly carried by a first, outer end of the jackscrew for receiving a drive member for rotating the jackscrew relative to the cross member.

15. A wall support in accordance with claim 14, wherein the drive element includes a pair of parallel flat surfaces for receiving a tool for turning the jackscrew.

16. A wall support in accordance with claim 14, wherein the drive element includes a substantially radially-extending aperture for receiving a tool for turning the jackscrew.

17. A well support in accordance with claim 14, including a bearing member rotatably received at a second, inner end of the jackscrew, and a bearing plate carried by the bearing member for engagement with a surface of the support beam to transmit support forces to the wall through the support beam.

18. A wall support in accordance with claim 1, wherein the wall support beam is an I-beam having oppositely-facing front and rear surfaces, wherein the front surface is in contact with the upper and lower jacking members and the rear surface is in contact with the wall surface, wherein the upper jacking member includes a cross member extending between and supported between the adjacent ceiling joists and including a side plate connected at each longitudinal end of the cross member and securely attached to a vertical face of an adjacent ceiling joist, a first threaded aperture provided in the cross member and a first threaded jackscrew rotatably received in the first threaded aperture, wherein the first jackscrew is arranged to impart a force against an upper section of the support beam to press the support beam against the wall surface and includes a first drive element rigidly carried by a first, outer end of the first jackscrew for receiving a drive member for rotating the first jackscrew relative to the cross member, a first bearing member rotatably received at a second, inner end of the first jackscrew and a bearing plate carried by the bearing member for engagement with the upper section of the support beam, wherein the lower jacking member includes an angle member having a first leg oriented substantially parallel to the wall surface and including a second threaded aperture and a second jackscrew rotatably received in the second threaded aperture, wherein the lower jacking member includes a second leg substantially perpendicular to the first leg for engagement with and attachment to the floor and a second drive element rigidly carried by a first, outer end of the second jackscrew for receiving a drive member for rotating the second jackscrew relative to the angle member, a second bearing member rotatably received at a second, inner end of the second jackscrew, and a second bearing plate carried by the second bearing member for engagement with a lower section of the support beam.

* * * * *